US012082665B2

(12) United States Patent
Nisguretsky

(10) Patent No.: US 12,082,665 B2
(45) Date of Patent: Sep. 10, 2024

(54) JEWELRY ARRANGEMENT SYSTEM

(71) Applicant: Barry Nisguretsky, New York, NY (US)

(72) Inventor: Barry Nisguretsky, New York, NY (US)

( * ) Notice: Subject to any disclaimer, the term of this patent is extended or adjusted under 35 U.S.C. 154(b) by 66 days.

(21) Appl. No.: 17/325,059

(22) Filed: May 19, 2021

(65) Prior Publication Data

US 2021/0361038 A1 Nov. 25, 2021

Related U.S. Application Data

(60) Provisional application No. 63/028,880, filed on May 22, 2020.

(51) Int. Cl.
*A44C 9/00* (2006.01)

(52) U.S. Cl.
CPC ..... *A44C 9/0023* (2013.01)

(58) Field of Classification Search
CPC ..... A44C 9/0015; A44C 9/003; A44C 15/00; A44C 15/001; A44C 9/0023
See application file for complete search history.

(56) References Cited

U.S. PATENT DOCUMENTS 858,450 A * 7/1907 Greenbaum ..... A44C 9/0023 63/27
993,797 A 5/1911 Sale
1,186,271 A 6/1916 Block
4,311,026 A * 1/1982 Ochoa ..... A44C 17/02 63/15
5,419,158 A * 5/1995 Sandberg ..... A44C 9/0015 63/15.3
5,735,144 A 4/1998 Gabel
8,479,537 B2 7/2013 Patterson
8,573,004 B2 11/2013 Demeglio
9,113,681 B2 8/2015 Machini
(Continued)

FOREIGN PATENT DOCUMENTS

DE 2404076 A1 7/1975
DE 10209563 A1 9/2003
(Continued)

OTHER PUBLICATIONS

Nordstrom: "Baby XL Safety Pin Ring"; URL: https://shop.nordstrom.com/s/apm-monaco-baby-xl-safety-pin-ring/5249673/full; retrieved on Jan. 19, 2020; 1 page.
(Continued)

*Primary Examiner* — Jack W Lavinder
(74) *Attorney, Agent, or Firm* — Tucker Ellis LLP

(57) ABSTRACT

In accordance with an embodiment, a jewelry arrangement system having interchangeable components includes: a plurality of jewelry pieces, each jewelry piece having at least one through hole formed in a portion thereof, and each jewelry piece is adapted to be arranged in a particular orientation relative to the other jewelry pieces within the plurality of jewelry pieces; and an alignment tool adapted to align different combinations of the at least one through holes formed in the plurality of jewelry pieces, to create a plurality of jewelry arrangements, including at least a first jewelry arrangement and one or more additional jewelry arrangements, using the plurality of jewelry pieces.

17 Claims, 16 Drawing Sheets

(56) References Cited

U.S. PATENT DOCUMENTS

| | | | |
|---|---|---|---|
| D758,910 | S | 6/2016 | Riviere |
| 9,380,843 | B2 | 7/2016 | Logian et al. |
| 9,468,269 | B2 | 10/2016 | Machini |
| 10,123,595 | B2 | 11/2018 | Machini |
| 2012/0159988 | A1 | 6/2012 | Baird et al. |

FOREIGN PATENT DOCUMENTS

| | | | |
|---|---|---|---|
| DE | 10209563 | B4 | 2/2008 |
| FR | 2928524 | A1 | 9/2009 |

OTHER PUBLICATIONS

APM Monaco: "Collection Baby XL Trio Silver Safety Pin Ring"; URL: https://www.apm.mc/en/a18166xtrh; retrieved on Jan. 19, 2020; 1 page.

* cited by examiner

JEWELRY ARRANGEMENT SYSTEM

CLAIM OF PRIORITY

This application claims the benefit of priority to U.S. Provisional Patent Application No. 63/028,880, titled "Jewelry Arrangement System," filed May 22, 2020, which is herein incorporated by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

Embodiments of the present invention relate generally to jewelry, and more particularly to a jewelry arrangement system having interchangeable components to permit a user to create a variety of different looks and styles.

BACKGROUND

Consumers who wear jewelry often like to mix and match different jewelry pieces to create a variety of desired looks and styles. However, it can be inconvenient and cumbersome to wear multiple jewelry pieces together, for example on the same part of the user's body, because the individual pieces are prone to move or shift around independently of one another and/or rotate into undesirable positions while being worn.

One solution to address this problem is to permanently join together separate jewelry pieces, in order to prevent them from moving independently of one another. For example, a wedding band can be fused to an engagement ring (e.g., by soldering the rings together) to prevent the rings from sliding around independently of one another while they are worn on the consumer's finger. However, such approaches do not afford the consumer the flexibility to change the look of the jewelry arrangement. They also do not adequately address the problem of undesirable spinning or rotation of the jewelry pieces while they are being worn.

Although some jewelry devices exist that use or include removable elements, these devices are generally designed to maintain a relatively fixed configuration of their constituent elements, rather than permitting a consumer to create a variety of different configurations. Further, the removable elements are typically designed for removal by a professional jeweler, and cannot be easily manipulated by a consumer in order to change the look and style of the jewelry arrangement on a day-to-day basis.

SUMMARY

Embodiments of the present invention relate generally to jewelry, and more particularly to a jewelry arrangement system having interchangeable components to permit a user to create a variety of different looks and styles.

In accordance with an embodiment, a jewelry arrangement system includes: a plurality of rings, each ring having a shank and at least one through hole formed in the shank; and an alignment tool adapted for insertion through the at least one through hole in the shank of each ring, and including a locking mechanism, whereupon insertion of the alignment tool into the at least one through hole of each ring, and engagement of the locking mechanism of the alignment tool, each ring within the plurality of rings is arranged in a particular orientation relative to the other rings, and the plurality of rings are removably coupled to form a jewelry arrangement configuration.

A first arrangement can be created upon alignment of a first set of through holes formed in the plurality of rings, and insertion of the alignment tool therethrough, and a second arrangement can be created upon alignment of a second set of through holes formed in the plurality of rings and insertion of the alignment tool therethrough.

The at least one through hole in one or more rings within the plurality of rings can be formed in a lower portion of the shank.

An upper portion of one or more rings within the plurality of rings can include one or more decorative elements.

One or more rings within the plurality of rings can have at least two through holes formed in the shank of the ring, and the at least two through holes can be positioned at an angle relative to the central axis of the ring.

The alignment tool can include a rod portion for receiving the plurality of rings, and the locking mechanism.

Disengagement of the locking mechanism can permit at least one of removal and rearrangement of one or more jewelry pieces from within the jewelry arrangement system.

The alignment tool can be spring loaded with a safety catch as part of the locking mechanism.

A diameter of the rod portion can be varied along a length of the rod portion.

In accordance with an embodiment, a jewelry arrangement system having interchangeable components includes: a plurality of jewelry pieces, each jewelry piece having at least one through hole formed in a portion thereof, wherein each jewelry piece is adapted to be arranged in a particular orientation relative to the other jewelry pieces within the plurality of jewelry pieces; and an alignment tool adapted to align different combinations of the at least one through holes formed in the plurality of jewelry pieces, to create a plurality of jewelry arrangements, including at least a first jewelry arrangement and one or more additional jewelry arrangements, using the plurality of jewelry pieces.

At least one jewelry piece of the plurality of jewelry pieces can have an upper portion that is asymmetric about its central axis.

At least one jewelry piece of the plurality of jewelry pieces can include at least two through holes, and selection of a particular one of the through holes can determine a degree of rotation of the jewelry piece.

The degree of rotation of the jewelry piece can cause a different portion of the jewelry piece to be visible from a top view.

At least one jewelry arrangement of the plurality of jewelry arrangements can include a subset of the plurality of jewelry pieces within the first jewelry arrangement.

At least one jewelry arrangement of the plurality of jewelry arrangements can include a different ordering of the plurality of jewelry pieces than in the first jewelry arrangement.

At least one jewelry arrangement of the plurality of jewelry arrangements can include at least one jewelry piece having a different visual appearance in a top view from the first jewelry arrangement.

The alignment tool can be adapted to be hidden from view while the jewelry piece is being worn by a user.

Other features and advantages of embodiments of the present invention will become apparent from the following detailed description, taken in conjunction with the accompanying drawings which illustrate, by way of example, features of the present invention.

DETAILED DESCRIPTION

Embodiments of the present invention relate generally to jewelry, and more particularly to a jewelry arrangement system having interchangeable components to permit a user to create a variety of different looks and styles.

In the following detailed description, certain example embodiments are shown and described, by way of illustration. As those skilled in the art would recognize, the described example embodiments may be modified in various ways without departing from the spirit and scope of the present invention. Accordingly, the drawings and description are to be regarded as illustrative in nature, rather than restrictive.

Figure 1:
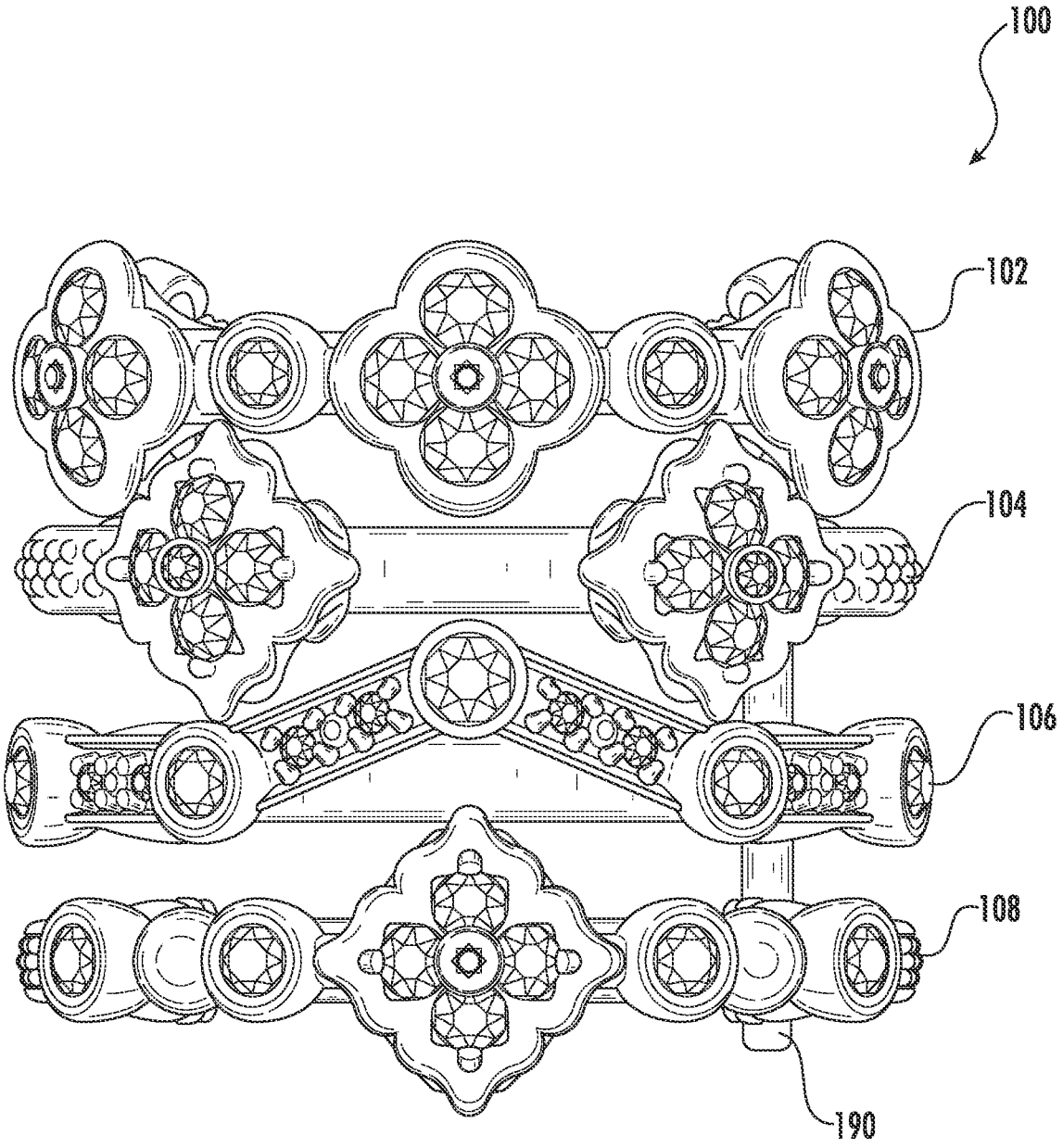
FIG. 1 is a top view of a jewelry arrangement system according to an embodiment.

FIG. 1 is a top view of a jewelry arrangement system 100 according to an embodiment.

As illustrated in FIG. 1, in accordance with an embodiment, a jewelry arrangement system 100 can include a plurality of jewelry pieces 102, 104, 106, 108. For example, the jewelry pieces 102, 104, 106, 108 can include a plurality of rings removably coupled to one another via an alignment tool 190. Each jewelry piece can have one or more through holes formed therethrough, for receiving the alignment tool 190.

In accordance with an embodiment, one or more of the jewelry pieces within the jewelry arrangement system can have a different visual appearance from the other jewelry pieces within the jewelry arrangement system. For example, as illustrated in FIG. 1, each jewelry piece 102, 104, 106, 108 can have one or more decorative or other jewelry elements formed thereon or therein, which give each respective jewelry piece a different visual appearance from the other rings, according to a top view.

Figure 2:
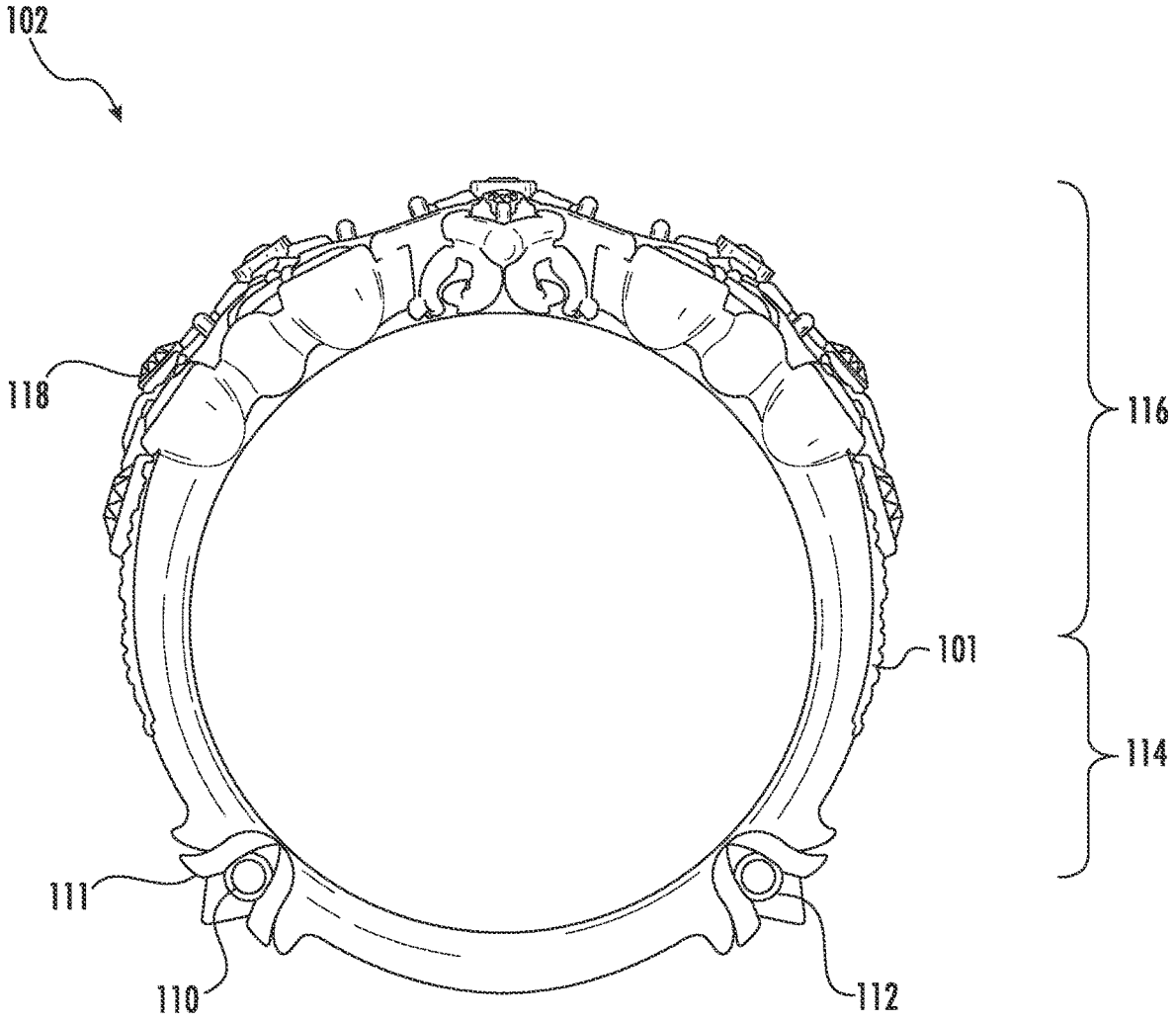
FIG. 2 is a front view of a jewelry piece according to an embodiment.

FIG. 2 is a front view of a jewelry piece 102 according to an embodiment.

In accordance with an embodiment, a jewelry piece within the jewelry arrangement system 100 can have one or more through holes formed in a side or other portion thereof. For example, as illustrated in FIG. 2, a jewelry piece 102 such as a ring within the jewelry arrangement system 100 can have through holes 110, 112 formed in a shank 101 of the ring. In accordance with an embodiment, the through holes 110 and 112 can be formed in a lower or bottom portion 114 of the shank 101, which is generally opposite the upper or top portion 116 of the ring where the decorative elements 118 of the ring are located. As such, when a user is wearing the jewelry piece, the decorative elements formed in or on the upper or top portion 116 of the jewelry piece can be visible from a top view, while the through holes 110 and 112 formed in the lower or bottom portion 114 of the jewelry piece are hidden or otherwise obscured from view by virtue of their location while the jewelry piece is being worn. Accordingly, once the alignment tool 190 is inserted into the through holes, the alignment tool can also be hidden or otherwise obscured from view while the jewelry piece is being worn. Accordingly, once the alignment tool 190 is inserted into the through holes, the alignment tool can also be hidden or otherwise obscured from view while the jewelry piece is being worn. In accordance with an embodiment, additional decorative elements, such as decorative elements 111, can be formed surrounding, above, below, or otherwise adjacent the one or more through holes 110 and 112, on a surface of the shank 101, to improve the appearance of the through holes and enhance the overall look of the jewelry piece.

In accordance with an embodiment, the one or more through holes 110 and 112 can be formed at particular positions in the lower or bottom portion of the jewelry piece. In an embodiment, the one or more through holes 110 and 112 can each be formed at an angle relative to the central axis of the jewelry piece. For example, where the jewelry piece 102 is represented by a unit circle when viewed from the front, the through holes 110, 112 can be formed in the third and fourth quadrants, for example at 225° and 315°. In another example, where the jewelry piece 102 is represented by clock positions as reference points, the through holes 110, 112 can be formed at the 5:00 and 7:00 clock positions. However, embodiments of the present invention are not limited thereto, and the one or more through holes can be formed in any suitable location or position that permits alignment of the plurality of jewelry pieces within the jewelry arrangement system.

In accordance with an aspect of some embodiments of the present invention, the use of a plurality of through holes (i.e., more than one through hole) in one or more jewelry pieces within the jewelry arrangement system can be advantageous in that it enables each jewelry piece to be positioned or arranged in more than one orientation, so that a plurality of combinations of the jewelry pieces can be created by a user. As such, according to an aspect, the through holes enable the interchangeable components of the jewelry arrangement system to be reconfigured relative to one or more of the ordering, type (e.g., color and/or style), quantity, and/or degree of rotation of the jewelry pieces therein.

Figure 3:
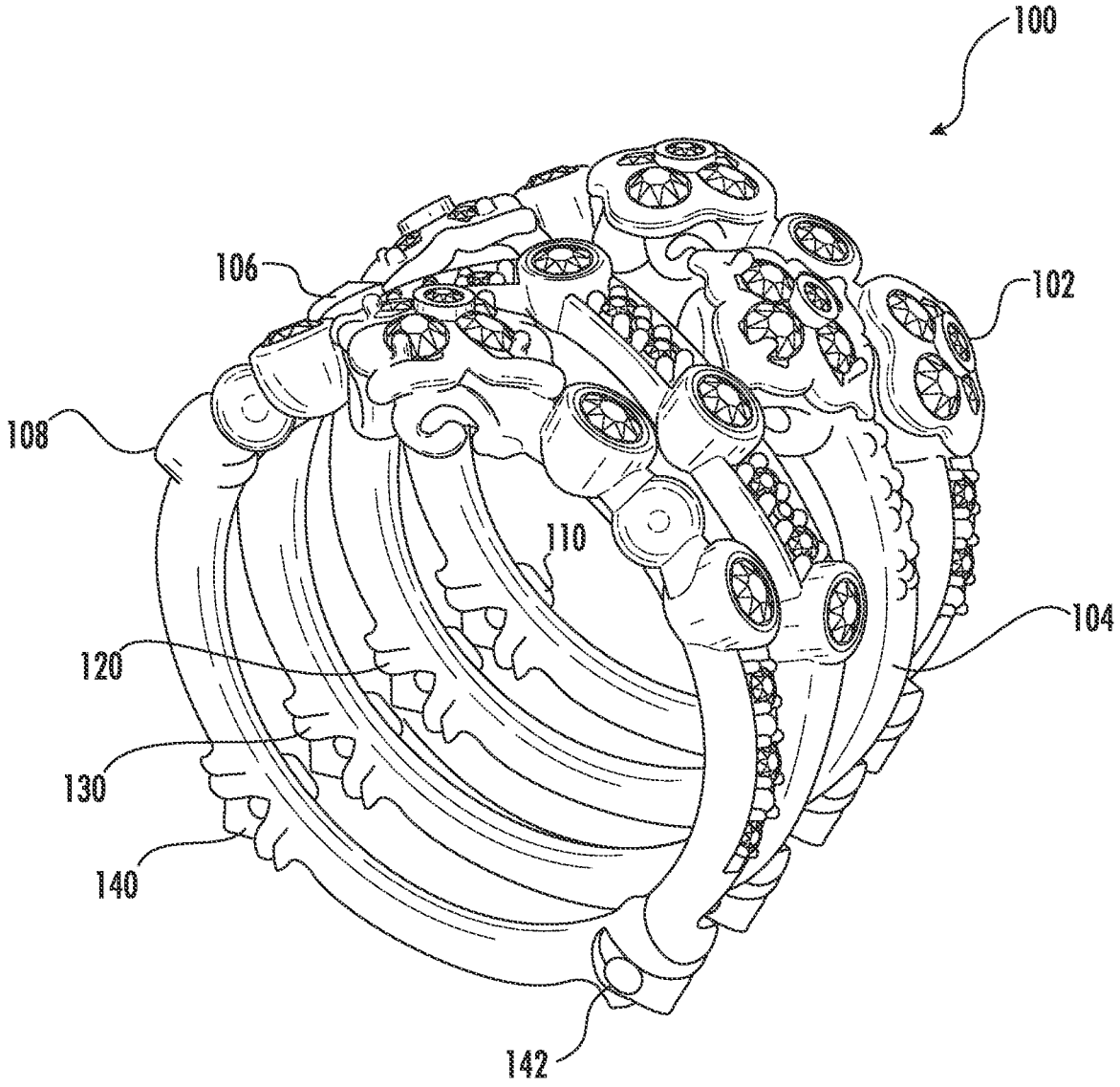
FIG. 3 is a perspective view of a jewelry arrangement system according to an embodiment.

FIG. 3 is a perspective view of a jewelry arrangement system 100 according to an embodiment.

Figure 4:
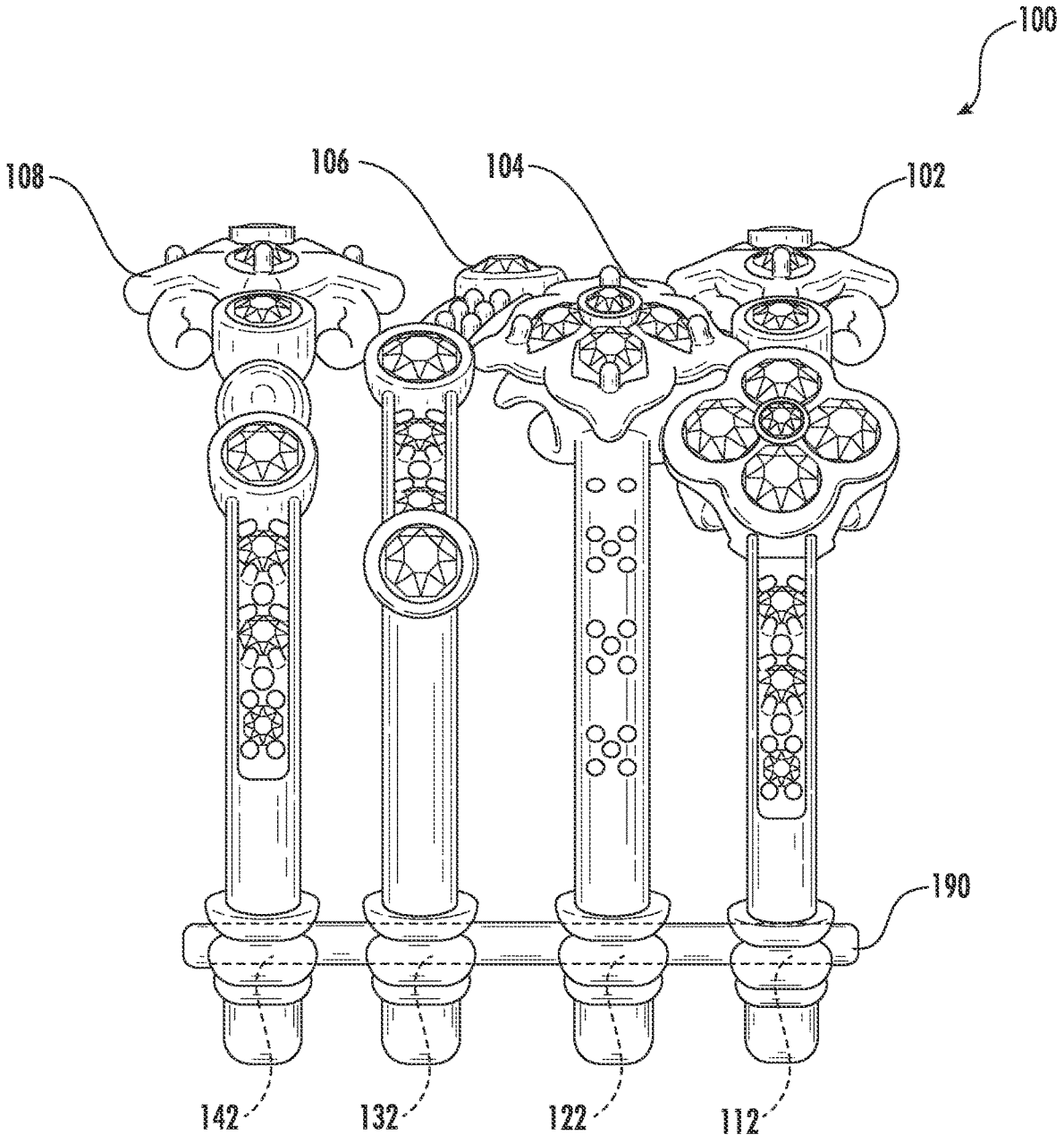
FIG. 4 is a side view of a jewelry arrangement system according to an embodiment.

FIG. 4 is a side view of the jewelry arrangement system 100 according to an embodiment.

As illustrated in FIGS. 3 and 4, in an embodiment, each jewelry piece 102, 104, 106, 108 within the jewelry arrangement can respectively include one or more through holes 112, 122, 132, 142 formed therein. The through holes 112, 122, 132, 142 can be aligned to form a first set of through holes for receiving an alignment tool 190 therethrough. Additionally or alternatively, each jewelry piece 102, 104, 106, 108 within the jewelry arrangement can respectively include one or more through holes 110, 120, 130, 140, which can be aligned to form a second set of through holes for receiving another alignment tool or the alignment tool 190. However, embodiments of the present invention are not limited thereto, and any suitable combination of through holes formed in the plurality of jewelry pieces can be used to align the jewelry pieces within the jewelry arrangement. For example, a set of through holes can include the through holes 110, 122, 130, 142 or any other combination of through holes. In accordance with an embodiment, a set of through holes can include any number of through holes greater than two. Furthermore, while some embodiments describe the use of one alignment tool, in other embodiments a plurality of alignment tools may be used.

In accordance with an embodiment, the alignment tool 190 is adapted to removably couple the plurality of jewelry pieces 102, 104, 106, 108 within the jewelry arrangement to one another. In accordance with an embodiment, when inserted into a set of through holes such as the through holes 112, 122, 132, 142 or the through holes 110, 120, 130, 140, the alignment tool 190 can be substantially parallel to a central axis of the arranged jewelry pieces. In accordance with an embodiment the alignment tool 190 can have any suitable length and shape for accommodating a plurality of jewelry pieces. For example, at least a portion of the alignment tool can have a length to accommodate at least two jewelry pieces thereon. For example, as shown in FIG. 4, the alignment tool 190 can include a rod portion having a length to accommodate up to four jewelry pieces. However, embodiments of the present invention are not limited thereto, and the alignment tool can have a length to accommodate fewer or more than four jewelry pieces thereon. In accordance with an embodiment, an extendible alignment tool can be provided which has an extendible or otherwise adjustable length. For example, the alignment tool can have one or more telescoped portions that can be expanded and collapsed to enable lengthening and shortening thereof, and which are adapted for insertion into the one or more through holes formed in the jewelry pieces.

In accordance with an embodiment, the alignment tool 190 can have any suitable shape and diameter for insertion into a set of through holes such as the through holes 112, 122, 132, 142 or the through holes 110, 120, 130, 140 respectively formed in the jewelry pieces. For example, the alignment tool can have a diameter sized to correspond to the diameter of one or more of the through holes, such that the alignment tool can fit snugly within the one or more through holes to prevent or reduce inadvertent and undesirable movement (e.g., sliding) of the jewelry pieces installed or arranged thereon. In accordance with an embodiment, the rod portion of the alignment tool is substantially uniform in diameter along its length. In accordance with another embodiment, the rod portion of the alignment tool can have a varied diameter along its length.

In accordance with an embodiment, after a first jewelry arrangement has been created, the alignment tool 190 can be removed by a user (e.g., the wearer or another end consumer), and a second, different arrangement of jewelry pieces can be created by rearranging the same or a subset of the jewelry pieces, or using a different set of jewelry pieces altogether, and selecting one or more through holes formed within the jewelry pieces for alignment. For example, a first set of through holes can be selected for alignment, which correspond to the right side of the respective jewelry pieces from a front view, to create a first jewelry arrangement. Thereafter, the alignment tool can be removed and a second set of through holes can be selected for alignment, which correspond to a different set of through holes from the first set (e.g., the through holes the left side of the respective jewelry pieces from a front view). However, as described above embodiments of the present invention are not limited thereto, and the second set of through holes can optionally include at least one through hole from the first set. The alignment tool can therefore be inserted through the second set of through holes to form another, second jewelry arrangement with a different visual appearance than the first jewelry arrangement. As such, in accordance with an embodiment, the components of the jewelry arrangement system are interchangeable to permit a user to create a variety of different looks and styles.

FIGS. 5 through 8 are top, front, perspective, and side views, respectively, of a jewelry piece according to an embodiment.

Figure 5:
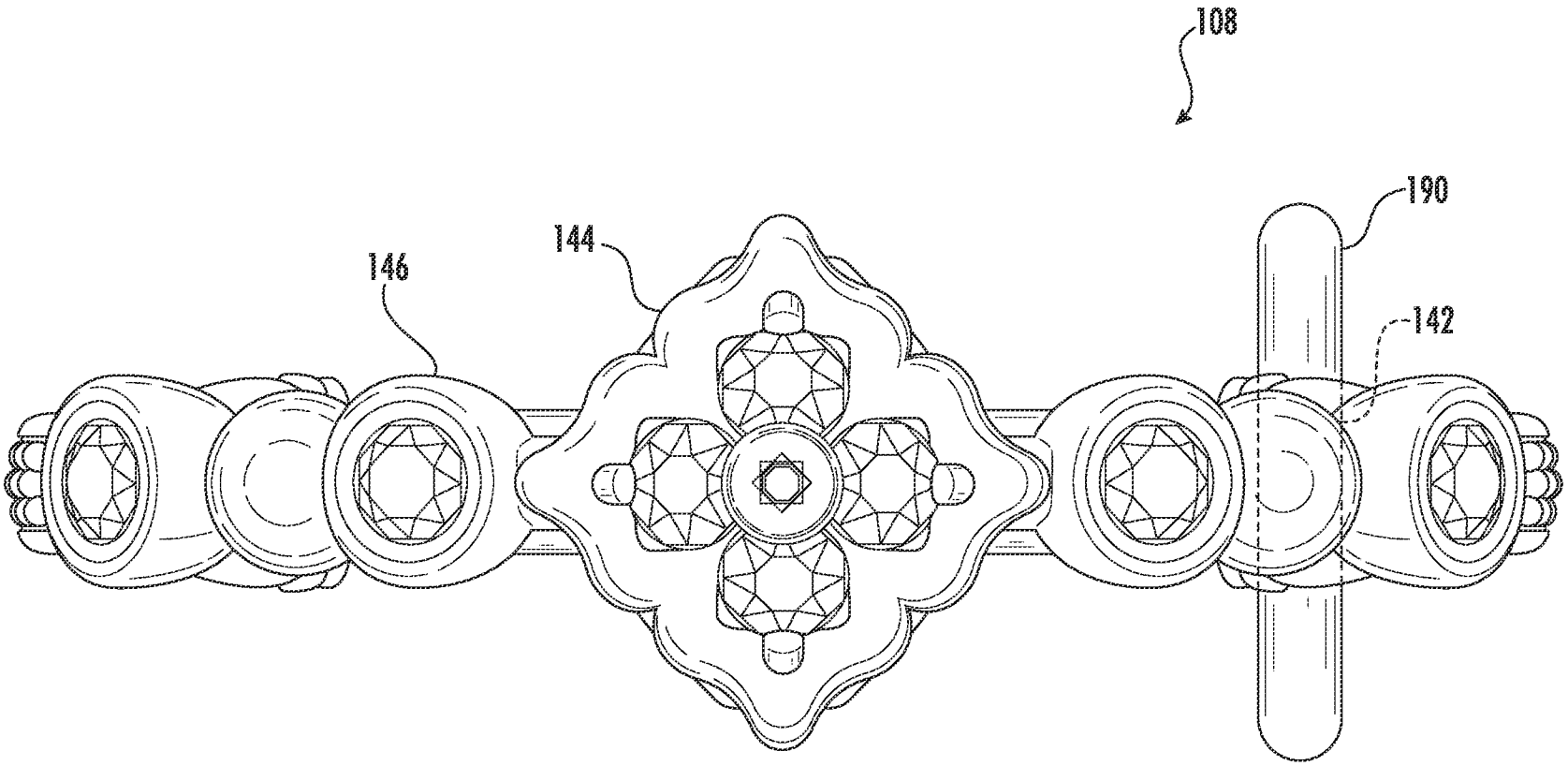
FIG. 5 is a top view of a jewelry piece according to an embodiment.

As illustrated in FIG. 5, in accordance with an embodiment, the jewelry piece 108 can have one or more decorative or other jewelry elements formed on an outer (or wearer-facing) surface of at least a portion of the jewelry piece. For example, the jewelry piece can have a primary decorative element 144 such as a gemstone within a setting, and one or more secondary decorative elements 146 on one or both sides of the primary decorative element. The decorative elements can be uniform or varied in size, shape, or other characteristics.

As further illustrated in FIG. 5, the alignment tool 190 can be inserted into the through hole 142 of the jewelry piece 108. One or more additional jewelry pieces can be installed on the alignment tool 190 as shown and described in relation to FIGS. 1 through 4.

Figure 6:
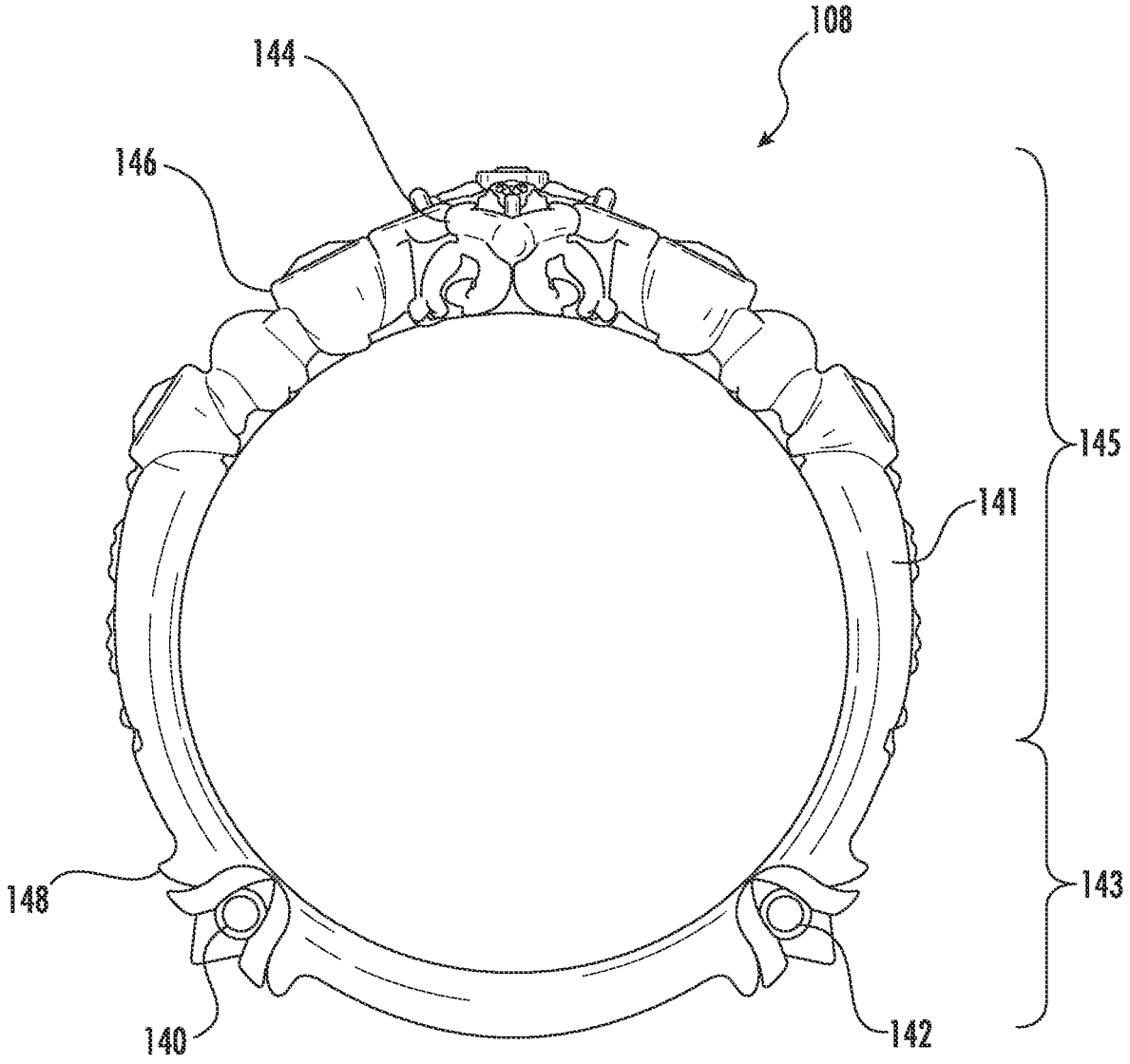
FIG. 6 is a front view of a jewelry piece according to an embodiment.
Figure 7:
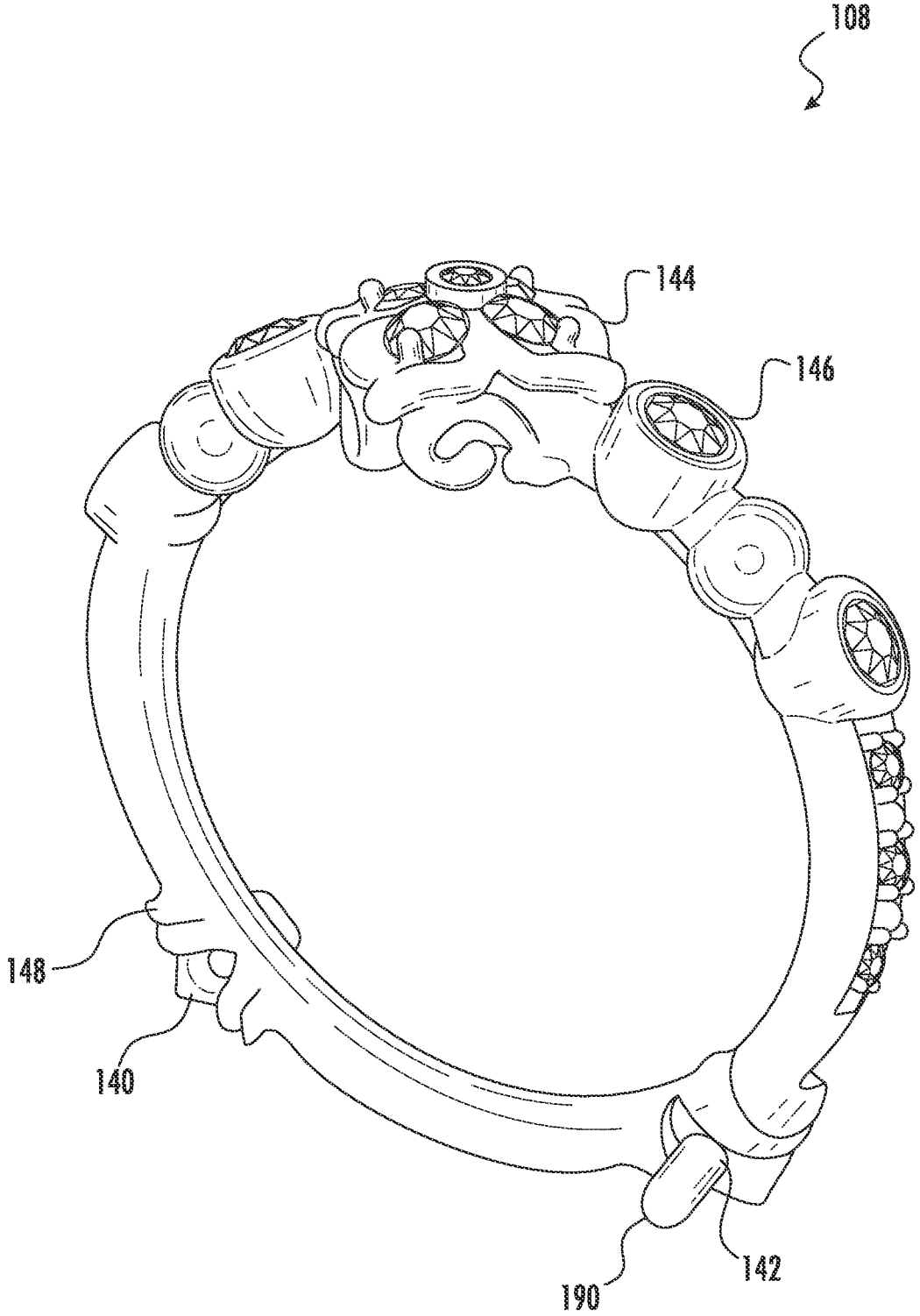
FIG. 7 is a perspective view of a jewelry piece according to an embodiment.
Figure 8:
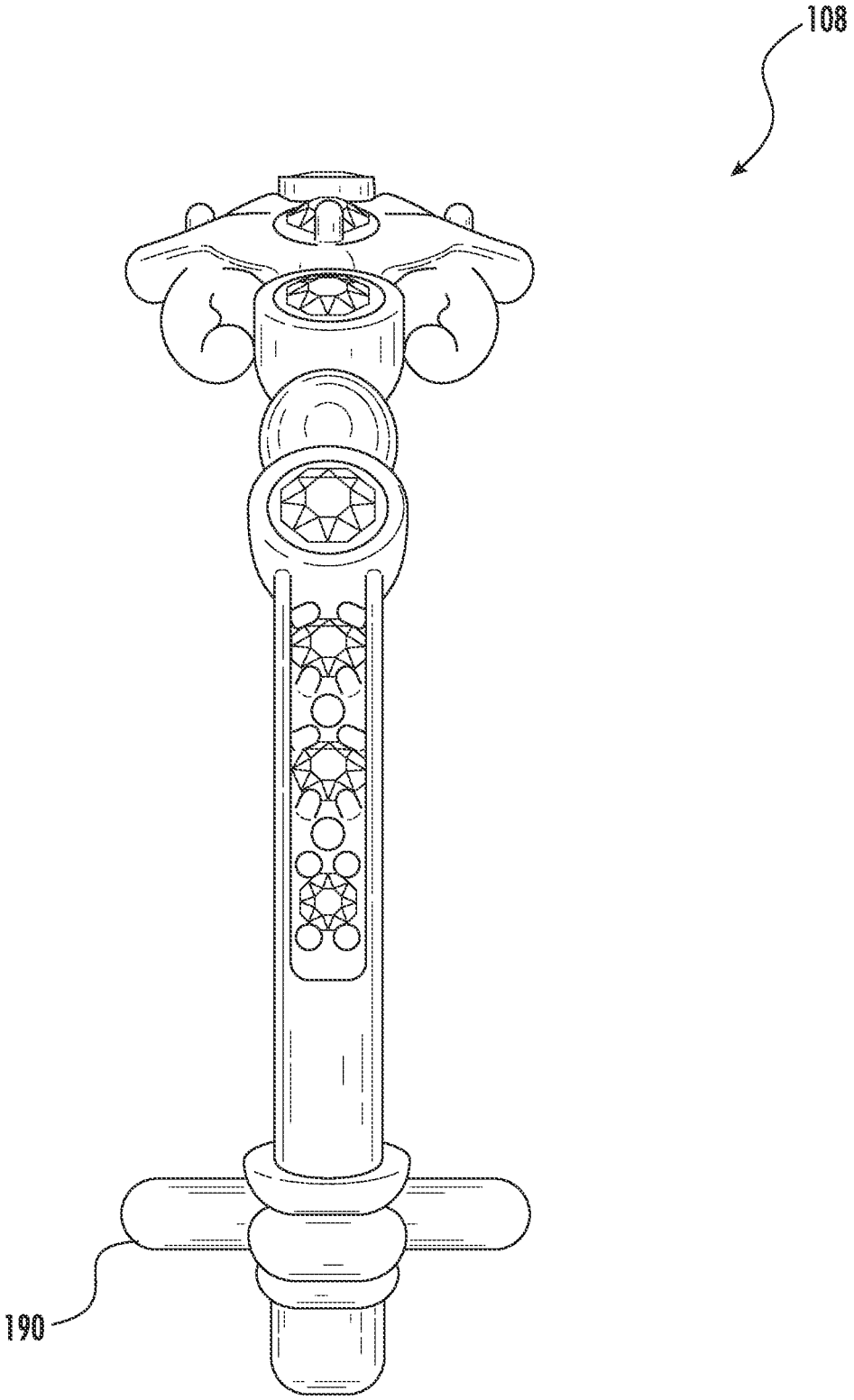
FIG. 8 is a side view of a jewelry piece according to an embodiment.

As illustrated in FIGS. 6-8, the jewelry piece 108 such as a ring within the jewelry arrangement system 100 can have through holes 140, 142 formed in a shank 141 of the ring. In accordance with an embodiment, the through holes 140 and 142 can be formed in a lower or bottom portion 143 of the shank 141, which is generally opposite the upper or top portion 145 of the ring where the decorative elements 144 and 146 of the ring are located. As such, when a user is wearing the jewelry piece, the decorative elements 144 and 146 formed in or on the upper or top portion 145 of the jewelry piece can be visible from a top view, while the through holes 140 and 142 formed in the lower or bottom portion 143 of the jewelry piece are hidden or otherwise obscured from view by virtue of their location while the jewelry piece is being worn. Accordingly, once the alignment tool 190 is inserted into the through holes, the alignment tool can also be hidden or otherwise obscured from view while the jewelry piece is being worn. In accordance with an embodiment, additional decorative elements, such as decorative elements 148, can be formed surrounding, above, below, or otherwise adjacent the one or more through holes 140 and 142, on a surface of the shank 141, to improve the appearance of the through holes and enhance the overall look of the jewelry piece.

In accordance with an embodiment, the one or more through holes 140 and 142 can be formed at particular positions in the lower or bottom portion of the jewelry piece. In an embodiment, the one or more through holes 140 and 142 can each be formed at an angle relative to the central axis of the jewelry piece. For example, where the jewelry piece 108 is represented by a unit circle when viewed from the front, the through holes 140, 142 could be formed in the third and fourth quadrants, for example at 225° and 315°. In another example, where the jewelry piece 108 is represented by clock positions as reference points, the through holes 140, 142 can be formed at the 5:00 and 7:00 clock positions. However, embodiments of the present invention are not limited thereto, and the one or more through holes can be formed in any suitable location or position that permits alignment of the plurality of jewelry pieces within the jewelry arrangement system.

FIGS. 9 through 12 are top, front, perspective, and side views, respectively, of a jewelry piece according to an embodiment.

Figure 9:
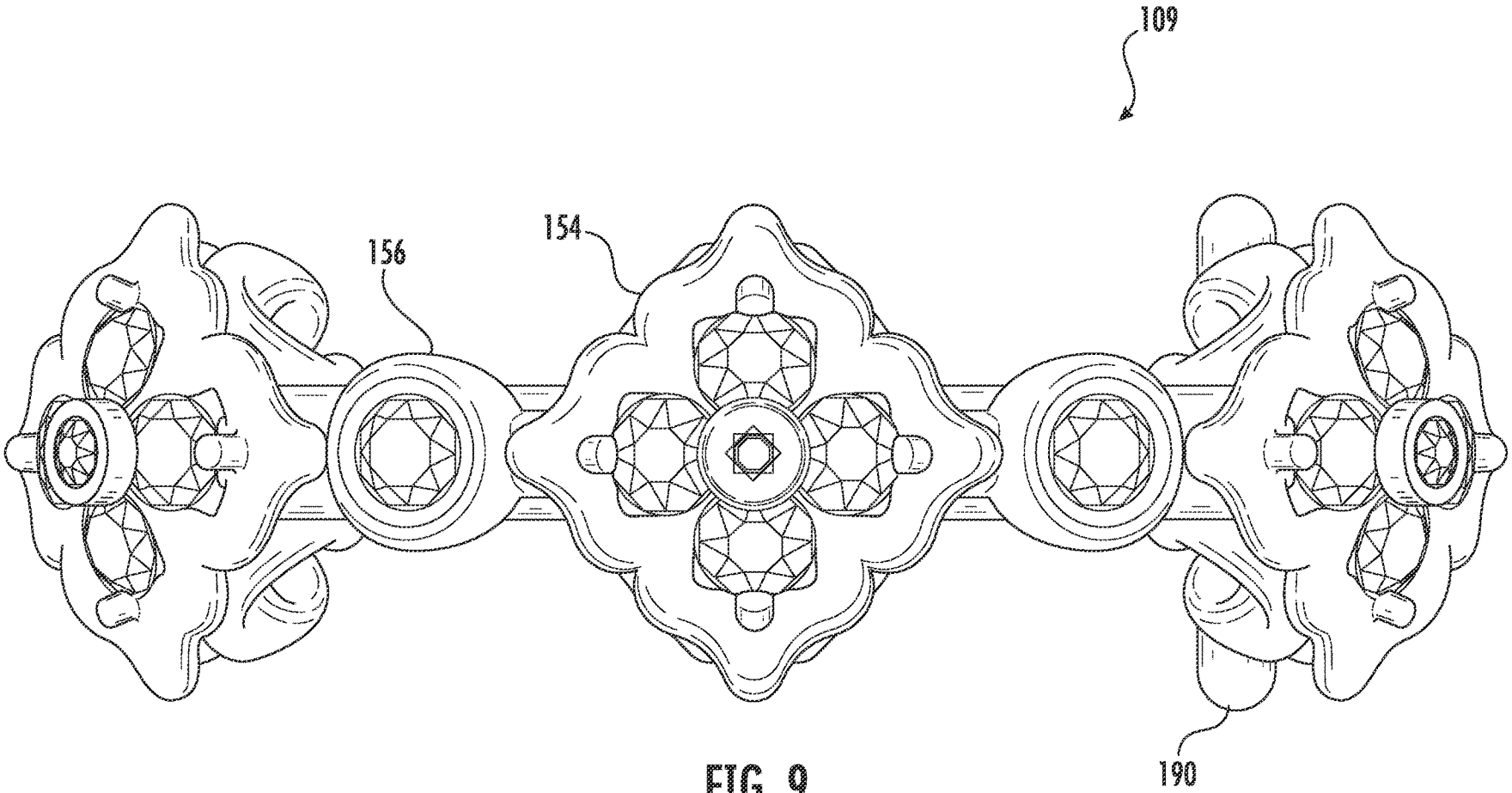
FIG. 9 is a top view of a jewelry piece according to an embodiment.

As illustrated in FIG. 9, in accordance with an embodiment, the jewelry piece 109 can have one or more decorative or other jewelry elements formed on an outer surface of at least a portion of the jewelry piece. For example, the jewelry piece can have a plurality of first decorative elements 154 and second decorative elements 156 therebetween. The decorative elements can be uniform or varied in size, shape, or other characteristics.

As further illustrated in FIG. 9, the alignment tool 190 can be inserted into the through hole of the jewelry piece 109. One or more additional jewelry pieces can be installed on the alignment tool 190 as shown and described in relation to FIGS. 1 through 4.

Figure 10:
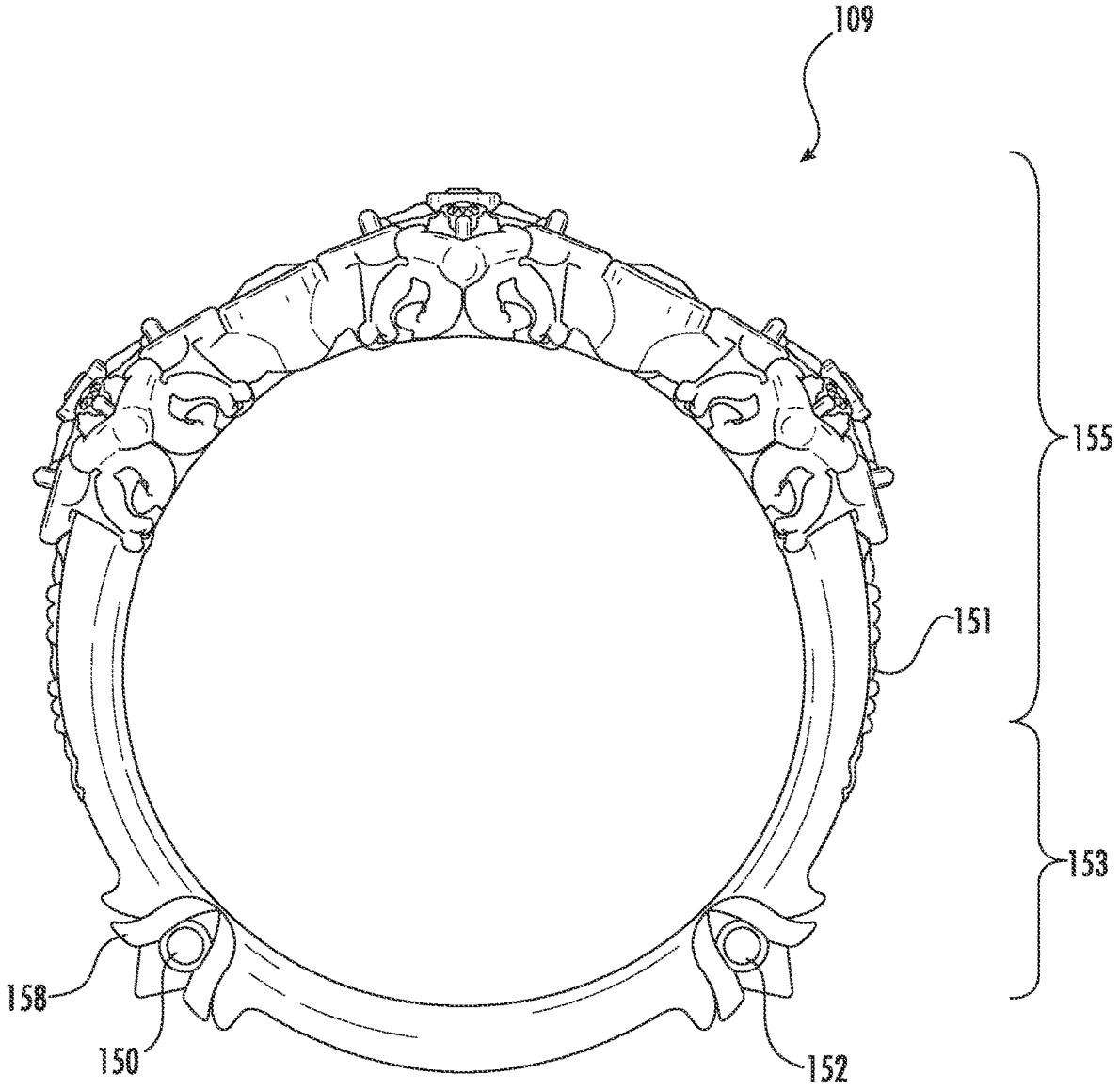
FIG. 10 is a front view of a jewelry piece according to an embodiment.
Figure 11:
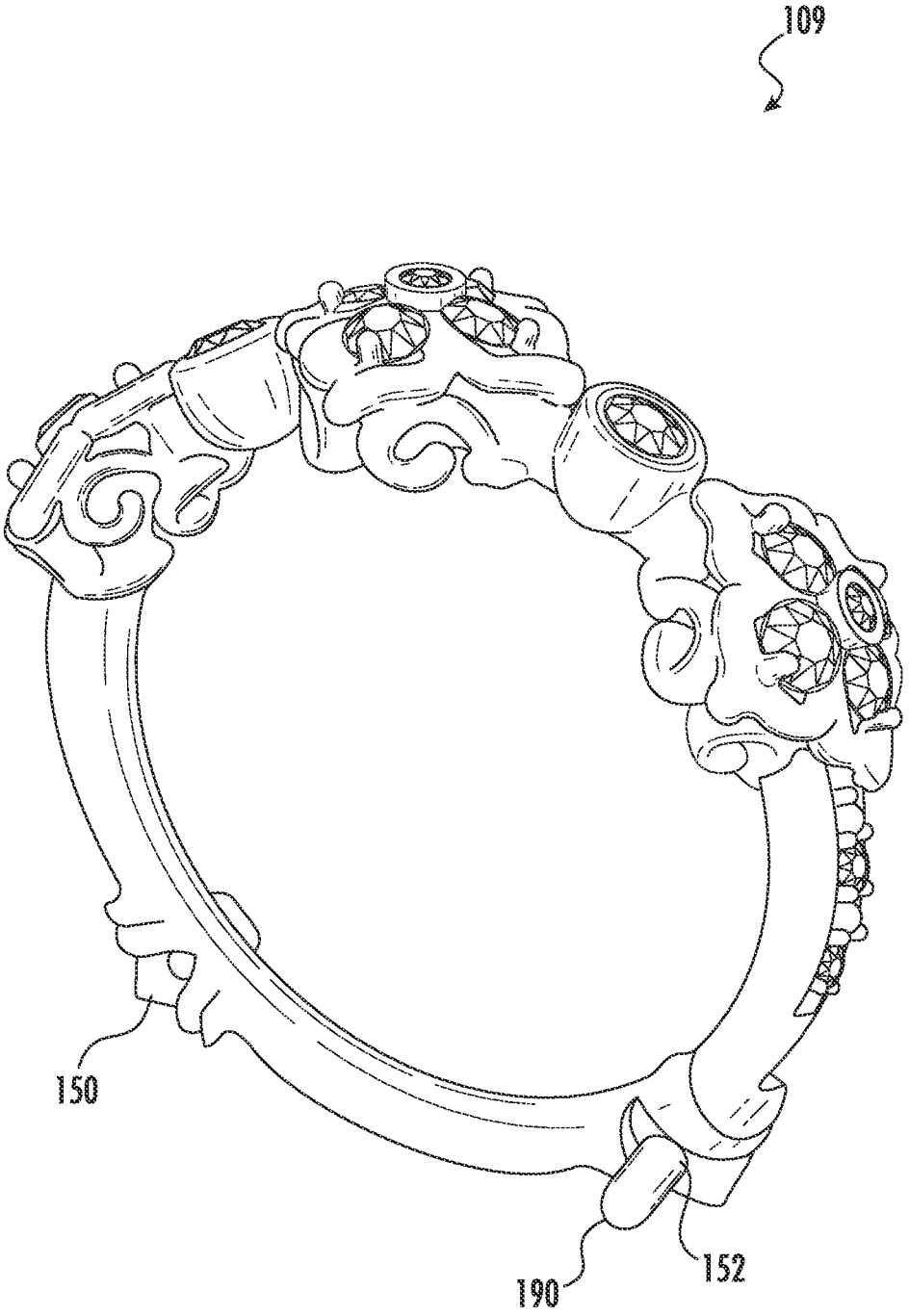
FIG. 11 is a perspective view of a jewelry piece according to an embodiment.
Figure 12:
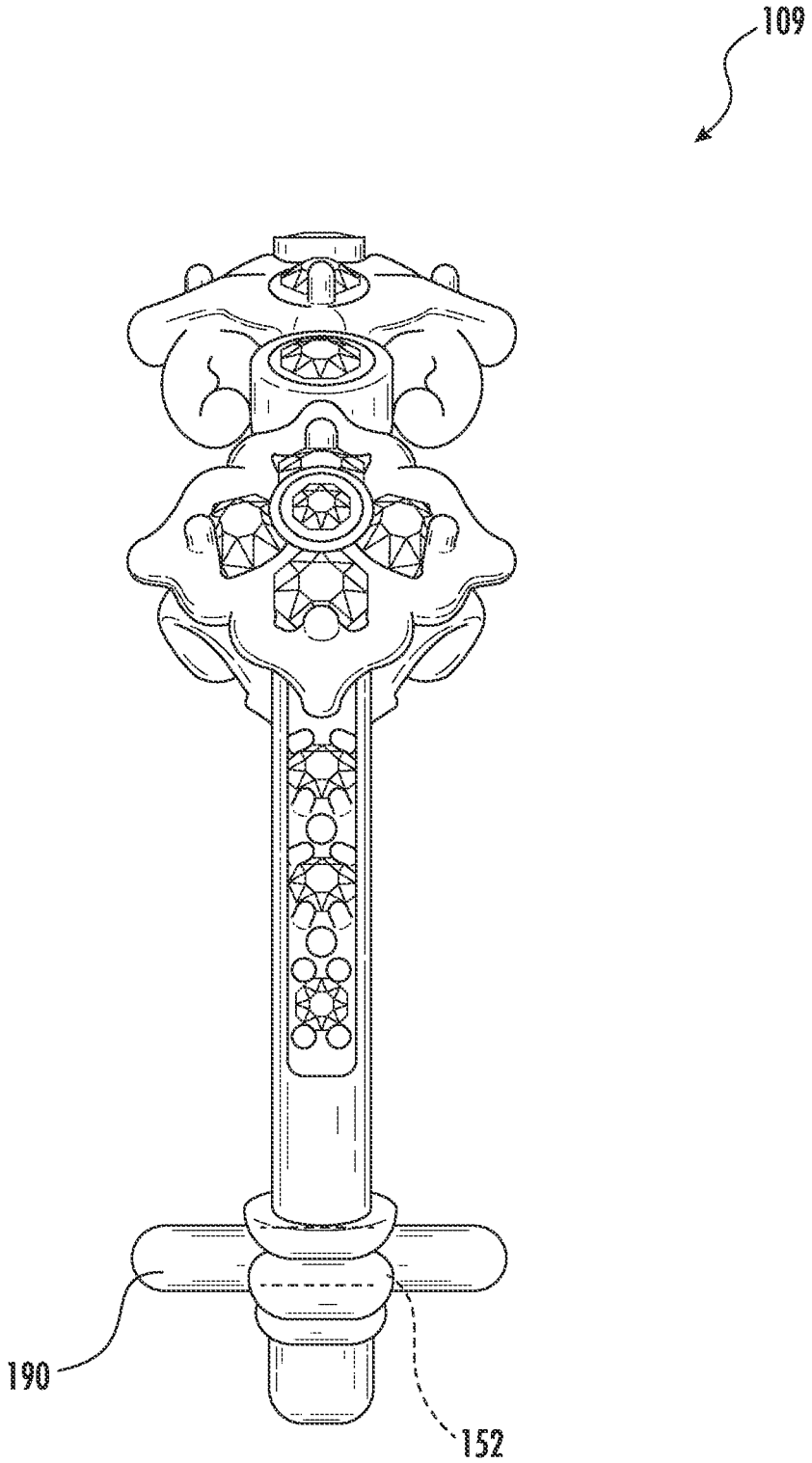
FIG. 12 is a side view of a jewelry piece according to an embodiment.

As illustrated in FIGS. 10-12, the jewelry piece 109 such as a ring within the jewelry arrangement system 100 can have the through holes 150, 152 formed in a shank 151 of the ring. In accordance with an embodiment, the through holes 150 and 152 can be formed in a lower or bottom portion 153 of the shank 151, which is generally opposite the upper or top portion 155 of the ring where the decorative elements of the ring are located. As such, when a user is wearing the jewelry piece, the decorative elements formed in or on the upper or top portion 155 of the jewelry piece can be visible from a top view, while the through holes 150 and 152 formed in the lower or bottom portion 153 of the jewelry piece are hidden or otherwise obscured from view by virtue of their location while the jewelry piece is being worn. Accordingly, once the alignment tool 190 is inserted into the through holes, the alignment tool can also be hidden or otherwise obscured from view while the jewelry piece is being worn. In accordance with an embodiment, additional decorative elements, such as decorative elements 158, can be formed surrounding, above, below, or otherwise adjacent the one or more through holes 150 and 152, on a surface of the shank 141, to improve the appearance of the through holes and enhance the overall look of the jewelry piece.

In accordance with an embodiment, the one or more through holes 150 and 152 can be formed at particular positions in the lower or bottom portion of the jewelry piece. In an embodiment, the one or more through holes 150 and 152 can each be formed at an angle relative to the central axis of the jewelry piece. For example, where the jewelry piece 109 is represented by a unit circle when viewed from the front, the through holes 150, 152 can be formed in the third and fourth quadrants, for example at 225° and 315°. In another example, where the jewelry piece 109 is represented by clock positions as reference points, the through holes 150, 152 can be formed at the 5:00 and 7:00 clock positions. However, embodiments of the present invention are not limited thereto, and the one or more through holes can be formed in any suitable location or position that permits alignment of the plurality of jewelry pieces within the jewelry arrangement system.

Although in some embodiments the alignment tool is illustrated as being installed on the right side of the jewelry arrangement (e.g., from a top or perspective view), embodiments of the present invention are not limited thereto, and the alignment tool can be installed on the left side of the jewelry arrangement (e.g., from a top or perspective view), or in any other suitable location as determined by selection of the through holes in the jewelry pieces for alignment.

Figure 13:
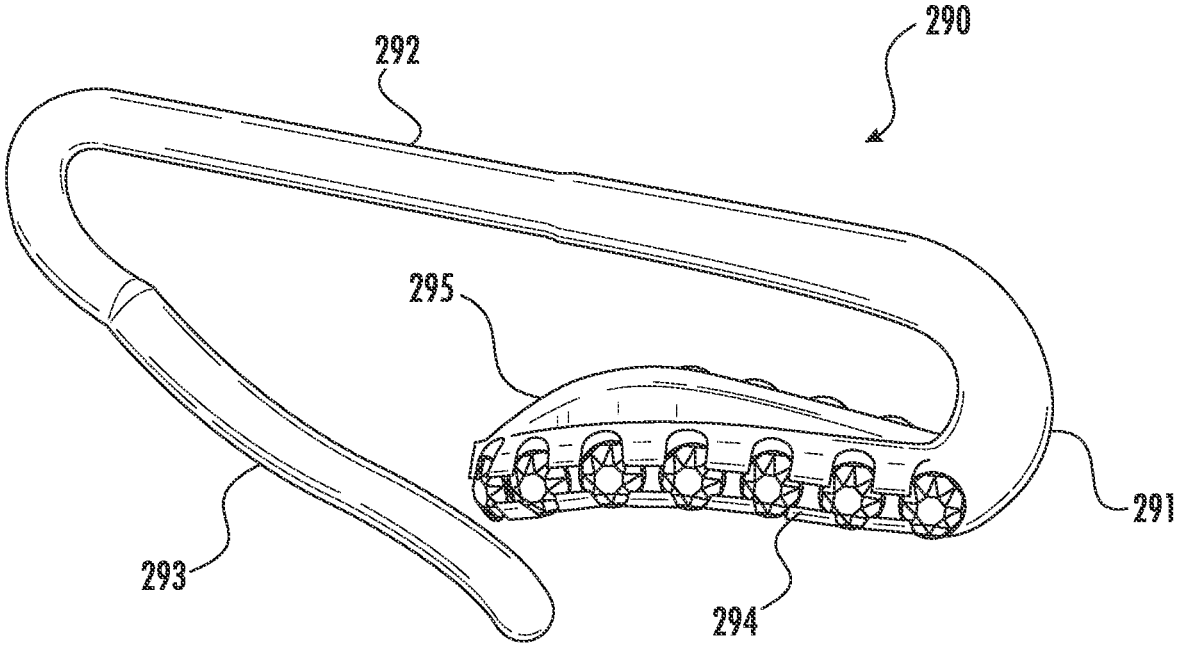
FIG. 13 is a perspective view of an alignment tool according to an embodiment.

FIG. 13 is a perspective view of an alignment tool 290 according to an embodiment.

In accordance with an embodiment, the alignment tool 290 can include a head portion 291, a rod portion 292, a pin portion 293, and a locking mechanism 294. According to an aspect of embodiments of the present invention, the locking mechanism 294 can be adapted to prevent the jewelry pieces installed on the alignment tool from being removed while the jewelry arrangement is being worn by a user. For example, the alignment tool 290 can be spring loaded with a safety catch 295 as part of the locking mechanism 294. In accordance with an embodiment, at least a portion of the alignment tool can include one or more decorative elements thereon, to improve the look of the alignment tool. For example, as illustrated in FIG. 13, an outer surface of a portion of the alignment tool, e.g., an outer surface that faces away from the rod portion on which the jewelry pieces are configured to be installed, can include one or more bezels for displaying stones or other decorative elements.

In accordance with an embodiment, a diameter of the rod portion 292 and a diameter of the pin portion 293 can correspond to or be determined in accordance with a diameter of the through holes formed in the jewelry pieces. The diameter of the pin portion 293 can be sized to permit easy installation of the jewelry pieces onto the alignment tool (e.g., by sliding the jewelry pieces onto the pin portion). For example, the diameter of at least a portion of the rod portion 292 and the diameter of the pin portion 293 can each be smaller than the diameter of the through holes formed in the jewelry pieces to be installed thereon, to allow the pin portion and the rod portion of the alignment tool to be inserted into the through holes. In an embodiment, the diameter of the pin portion 293 can be smaller than the diameter of the smallest corresponding through hole formed in the jewelry pieces. In accordance with an embodiment, the rod portion can have a substantially uniform diameter along its length. In accordance with another embodiment, the rod portion can have a varied diameter along its length (e.g., thinner towards the pin portion 293 and gradually increasing in diameter towards the head portion 292). The rod portion 292 can have any suitable shape and/or diameter sized to prevent undue movement (e.g. sliding) of the jewelry pieces along the length of the rod portion while the jewelry pieces are installed thereon. In accordance with an embodiment, the weight of the head portion 291 can act as a counterweight, to counterbalance the weight of top-heavy decorative elements on the jewelry pieces and prevent or reduce inadvertent rotation or spinning of the jewelry pieces while they are being worn.

Figures 14, 15, 16, 17, 18, 19:
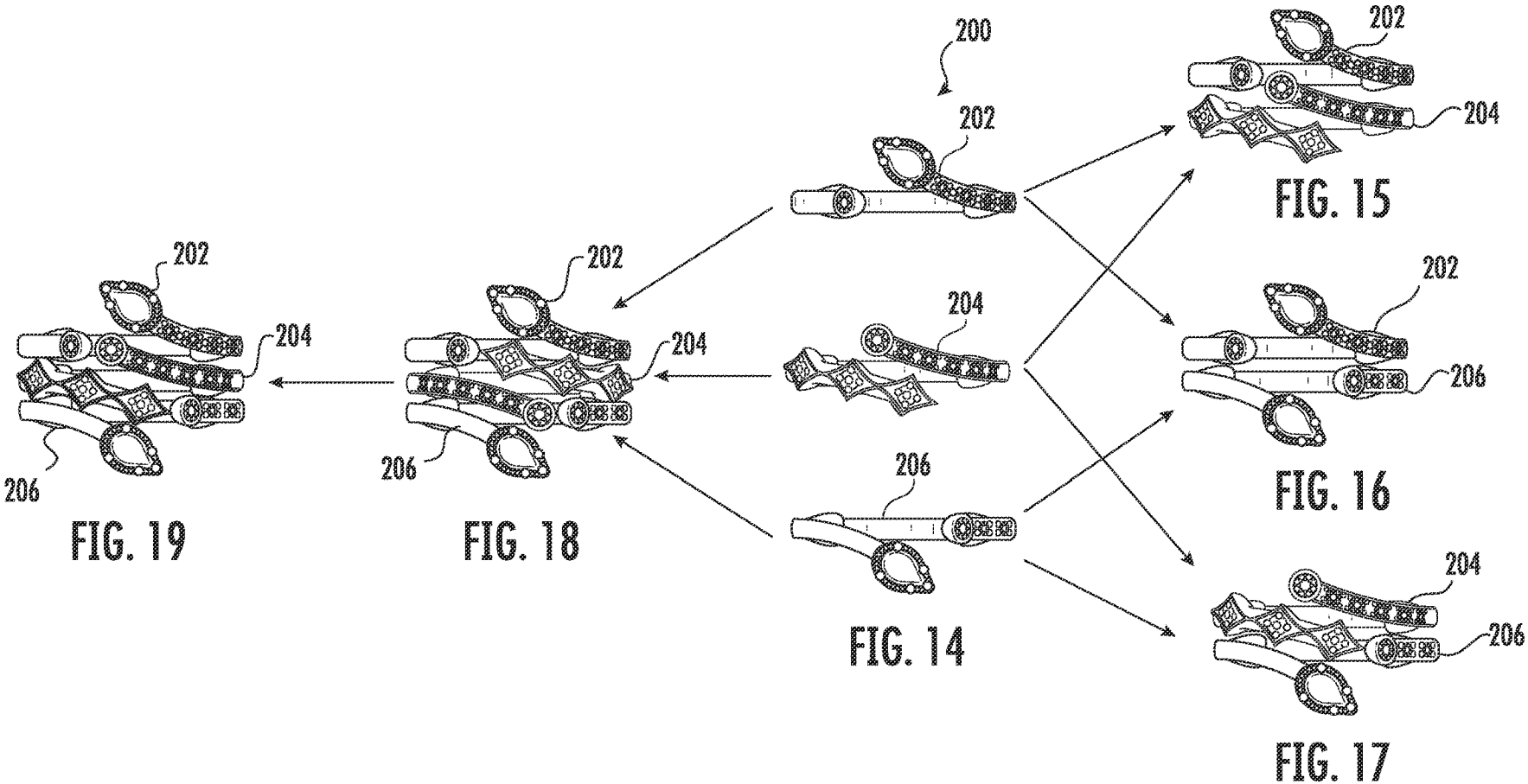
FIG. 14 is a top view of a plurality of jewelry pieces according to an embodiment.
FIG. 15 is a top view of a jewelry arrangement according to an embodiment.
FIG. 16 is a top view of a jewelry arrangement according to an embodiment.
FIG. 17 is a top view of a jewelry arrangement according to an embodiment.
FIG. 18 is a top view of a jewelry arrangement according to an embodiment.
FIG. 19 is a top view of a jewelry arrangement according to an embodiment.

FIG. 14 is a top view of a plurality of jewelry pieces according to an embodiment.

In accordance with an embodiment, one or more jewelry pieces within the plurality of jewelry pieces can have a visual appearance that is asymmetric about the jewelry piece's central axis, e.g., from a top view. For example, as illustrated in FIG. 14, the jewelry piece 202 has a different decorative element (e.g., a tear drop-shaped accent) on its right side than on its left side. The jewelry pieces 204 and 206 are similarly asymmetric about their respective central axes, having different decorative elements on their left sides than on their right, from a top view. For example, jewelry piece 204 has diamond-shaped accents on its left side and round-shaped accents on its right side. The jewelry piece 206 has similar decorative elements to those of the jewelry piece 202 but is in a 180° rotated orientation in comparison to the jewelry piece 202.

In accordance with an embodiment, each jewelry piece 202, 204, 206 can be worn separately as an individual piece, or worn together with one or more other jewelry pieces as part of the jewelry arrangement system 200.

FIGS. 15 through 17 are respective top views of jewelry arrangements according to an embodiment.

In accordance with an embodiment, a different quantity and/or selection of jewelry pieces can be used to create one or more jewelry arrangements using the jewelry arrangement system. As illustrated in FIGS. 15 through 17, a subset of the jewelry pieces 202, 204, 206 can be selected to create one or more jewelry arrangements. For example, as illustrated in FIG. 15, jewelry pieces 202 and 204 can be combined to create a jewelry arrangement. In an embodiment, the jewelry piece 202 can be positioned in a top position relative to the jewelry piece 204, i.e., above the jewelry piece 204, when it is worn on a user's finger. As illustrated in FIG. 16, jewelry pieces 202 and 206 can be combined to create another jewelry arrangement. In an embodiment, the jewelry piece 202 can be positioned in a top position relative to the jewelry piece 206, i.e., above the jewelry piece 206, when it is worn on a user's finger. As illustrated in FIG. 17, jewelry pieces 204 and 206 can be combined to create yet another jewelry arrangement. In an embodiment, the jewelry piece 204 can be positioned in a top position relative to the jewelry piece 206, i.e., above the jewelry piece 206, when it is worn on a user's finger. In the embodiments shown in FIGS. 15 through 17, each of the jewelry pieces 202, 204, 206 has one or more through holes formed in a shank thereof, and upon alignment of the one or more through holes, and insertion of an alignment tool therethrough, the jewelry pieces can be removably coupled to one another to create each depicted jewelry arrangement configuration. In some embodiments, the through holes on the right side of the jewelry pieces are aligned. In some embodiments, the through holes on the left side of the jewelry pieces are aligned. In some embodiments, the jewelry arrangement system 200 can include one or more jewelry pieces each having two or more through holes formed therethrough. One or both through holes in each jewelry piece can be selected for alignment and insertion of the alignment tool.

FIGS. 18 and 19 are respective top views of jewelry arrangements according to an embodiment.

In accordance with an embodiment, the plurality of jewelry pieces can be arranged in any desired order. For example, as illustrated in FIG. 18, in accordance with an embodiment, jewelry pieces 202, 204, and 206 can be combined to create a jewelry arrangement in which jewelry piece 202 is in a top position relative to the jewelry pieces 204, 206; jewelry piece 204 is in a center position relative to the jewelry pieces 202, 206; and jewelry piece 206 is in a bottom position relative to the jewelry pieces 202, 204. In an embodiment, each of the jewelry pieces 202, 204, 206 has one or more through holes formed therethrough, and upon alignment of the one or more through holes, and insertion of the alignment tool therethrough, the jewelry pieces can be removably coupled to one another to create the depicted jewelry arrangement configuration.

In accordance with an embodiment, the plurality of jewelry pieces can also be arranged to have a different orientation. Selection of a particular one of the through holes for alignment determines a first orientation of the jewelry piece, and selection of a different through hole for alignment can determine a second orientation of the same jewelry piece. The second orientation can create a different visual appearance from the first orientation. For example, as illustrated in FIG. 19, in accordance with an embodiment, jewelry piece 204 can be flipped 180° such that the diamond-shaped decorative elements that were previously on the right now appear on the left, and the round-shaped accents that were previously on the left now appear on the right. As such, the jewelry arrangement depicted in FIG. 19 has a noticeably different visual appearance than the jewelry arrangement depicted in FIG. 18. In accordance with an embodiment, different through holes can be selected to display a particular orientation of the jewelry piece from a top view, and/or to provide a particular alignment of the decorative elements on the jewelry piece (e.g., a particular bezel alignment) with the decorative elements on the other jewelry pieces within the arrangement.

Figure 20:
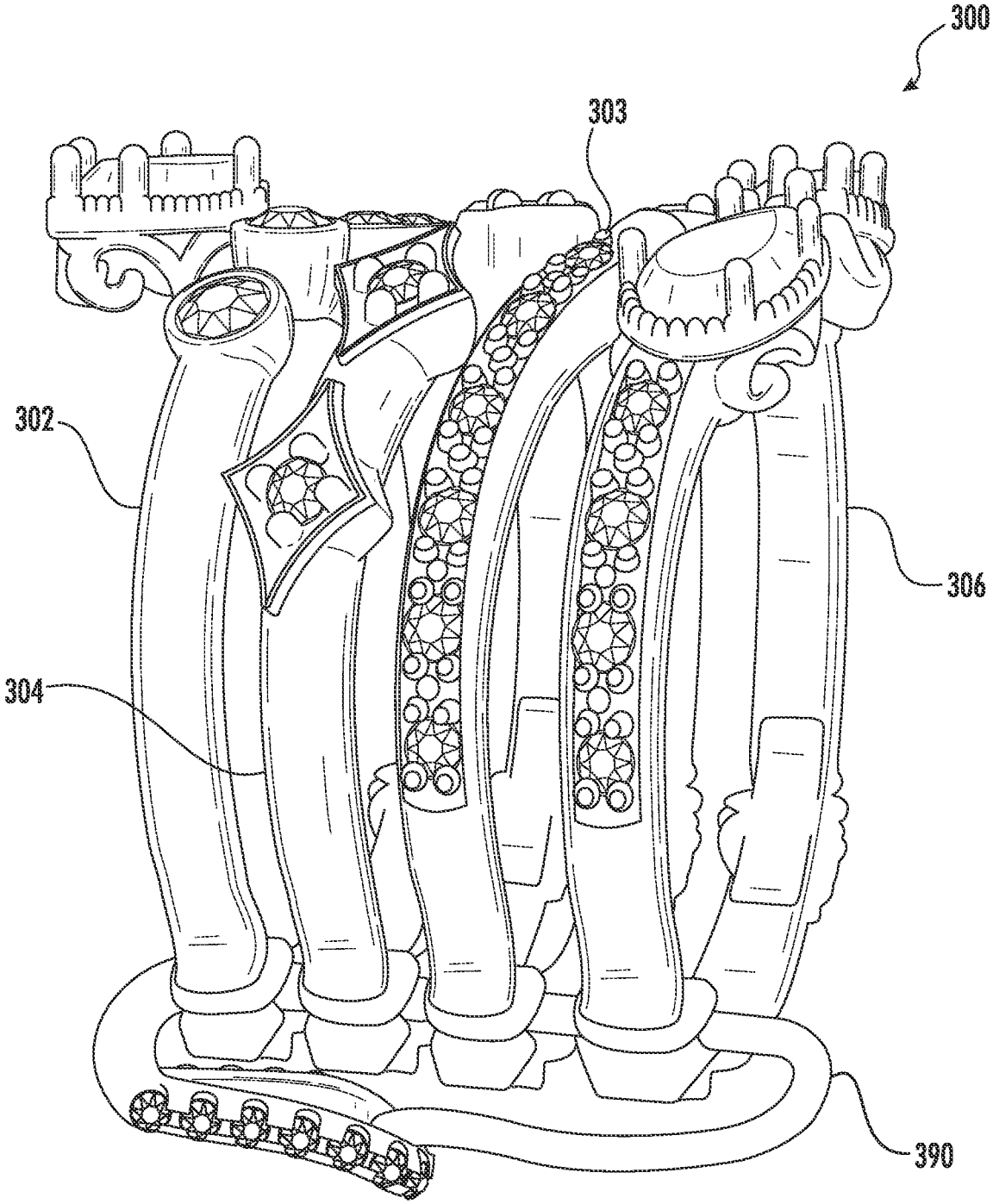
FIG. 20 is a perspective view of a jewelry arrangement system according to an embodiment.

FIG. 20 is a perspective view of a jewelry arrangement system according to an embodiment.

As illustrated in FIG. 20, a jewelry arrangement system 300 can include a plurality of jewelry pieces such as rings 302, 303, 304, and 306, each having one or more through holes formed in its shank. In accordance with an embodiment, an alignment tool 390 can be used to configure the plurality of jewelry pieces by aligning a set of through holes in the jewelry pieces. For example, a rod portion of the alignment tool 190 can be inserted through the through holes, to removably couple the plurality of jewelry pieces and hold them together.

Although in some embodiments the jewelry pieces are illustrated as having two through holes of similar diameter, embodiments of the present invention are not limited thereto. In accordance with other embodiments, any suitable quantity, diameter, or placement/location of through holes can be used.

For example, in an embodiment, a jewelry arrangement system can include one or more jewelry pieces having through holes with different diameters from one another.

Figure 21:
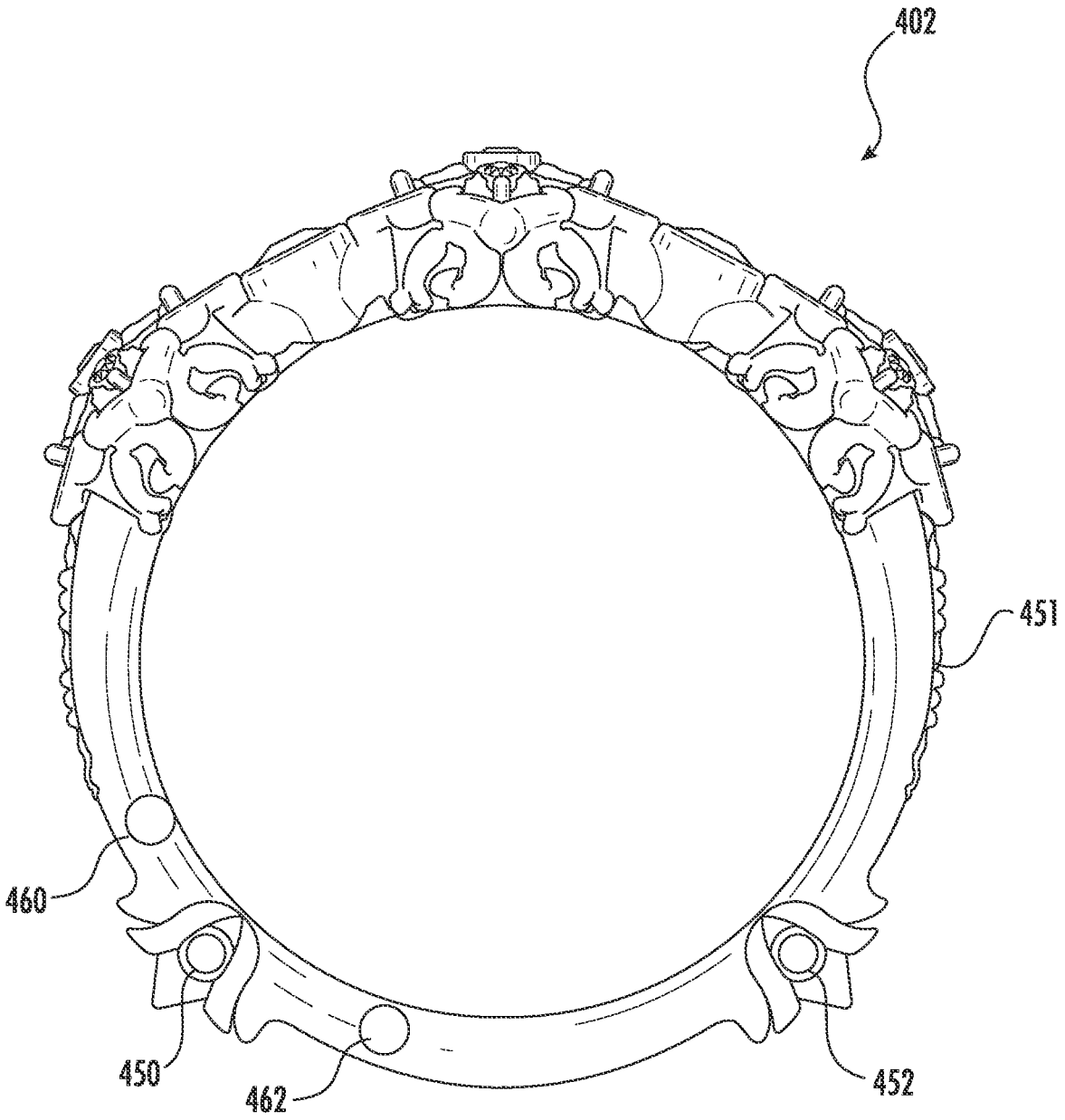
FIG. 21 is a front view of a jewelry piece in accordance with an embodiment.

FIG. 21 is a front view of a jewelry piece in accordance with an embodiment.

As illustrated in FIG. 21, a jewelry piece 402 can have a first through hole 450 having a first diameter and a second through hole 452 having a second diameter smaller than the first diameter. Additionally or alternatively, in accordance with an embodiment one or more through holes 460, 462 can be formed in the shank at various angles relative to the central axis (e.g., other than at the 225° and 315° positions on a unit circle or the 5:00 and 7:00 clock positions described above).

In accordance with an embodiment, the plurality of jewelry pieces can also be arranged to have a different degree of orientation when viewed from a top view. Each of the through holes when selected for alignment and insertion of the alignment tool can determine a particular degree of rotation of the jewelry piece, and the degree of rotation of the jewelry piece causes a different portion of the jewelry piece to be visible (e.g., to the wearer) from a top view. For example, insertion of the alignment tool into through hole 450 can determine a particular degree of rotation of the jewelry piece and cause a particular portion of the decorative elements to be displayed from a top view, while insertion of the alignment tool into through hole 460 determines a different degree of rotation of the jewelry piece and causes a different or slightly different portion of the decorative elements to be displayed from a top view.

In accordance with an embodiment, different through holes can also be selected to provide a particular alignment of the decorative elements on the jewelry piece (e.g., a particular bezel alignment) with the decorative elements on the other jewelry pieces within the same arrangement.

In accordance with an embodiment of the present invention, one or more jewelry pieces within the jewelry arrangement system can be substantially made of precious or semi-precious metals, such as gold, silver or platinum, and can be fitted with a variety of precious gemstones, such as diamonds, rubies, emeralds, opals, etc. However, embodiments of the present invention are not limited thereto, and the jewelry pieces can be substantially made of any other material, including one or more base metals such as brass, copper, bronze, aluminum, or a combination of different metals, plated metals, silicone, rubber, plastic, wood, leather, or fabric. For example, the jewelry pieces within the jewelry arrangement system can include different variations or combinations of colors for one or more of the gems or metals. In accordance with an embodiment, by using different colors for the gems and/or metals, each jewelry piece within the jewelry arrangement system can be formed to have a distinctive appearance, alone and when arranged in combination with the other pieces in the jewelry arrangement system. In accordance with an embodiment, one or more of the jewelry pieces within the jewelry arrangement system can be a wedding band. In accordance with an embodiment, the jewelry pieces within the jewelry arrangement system are not limited to rings; the jewelry pieces can have any shape that enables the jewelry piece to surround and/or be worn on a finger, wrist, arm, neck, or other similar appendage.

In accordance with an embodiment, the alignment tool can be made of any suitable precious or non-precious metal material, or a non-metal material such as plastic or another composite material.

Although in some embodiments the through holes can be formed in the shank of a ring, in accordance with other embodiments the through holes can be formed in any suitable portion of a jewelry piece that permits alignment of the jewelry piece with other jewelry pieces.

The foregoing description has been presented with reference to various embodiments. The embodiments were chosen and described in order to explain the principles of the invention and its practical application. The foregoing description is not intended to be exhaustive or to limit the invention to the precise forms disclosed. Further, while the various embodiments describe particular combinations of features of the invention it should be understood that different combinations of the features will be apparent to persons skilled in the relevant art as within the scope of the invention such that features of one embodiment may be incorporated into another embodiment. Moreover, it will be apparent to persons skilled in the art to which this invention pertains various additions, subtractions, deletions, variations, and other modifications and changes in form, detail, implementation and application can be made therein without departing from the spirit and scope of the invention. It is intended that the broader spirit and scope of the invention be defined by the following claims and their equivalents.

What is claimed is:

1. A jewelry arrangement system comprising:

a plurality of rings, each ring having a shank and at least one through hole formed in the shank; and an alignment tool adapted for insertion through the at least one through hole formed in a lower portion of the shank of each ring opposite an upper portion having one or more decorative elements thereon, and comprising a head portion and a rod portion, and a locking mechanism on the head portion that is configured to be engaged and disengaged to permit locking and unlocking of the alignment tool, whereupon insertion of the rod portion of the alignment tool into a first selection of through holes of the plurality of rings, and engagement of the locking mechanism on the head portion of the alignment tool to lock the alignment tool, each ring within the plurality of rings is arranged in a particular orientation relative to the other rings, and the plurality of rings are removably coupled to form a jewelry arrangement configuration, and wherein the locking mechanism on the head portion of the alignment tool is configured to be disengaged to permit removal and insertion of the alignment tool through another selection of through holes of the plurality of rings.

2. The jewelry arrangement of claim 1, wherein a first arrangement is created upon alignment of a first set of through holes formed in the plurality of rings, and insertion of the alignment tool therethrough, and a second arrangement is created upon alignment of a second set of through holes formed in the plurality of rings and insertion of the alignment tool therethrough.

3. The jewelry arrangement of claim 2, wherein one or more rings within the plurality of rings have at least two through holes formed in the shank of the ring, and the at least two through holes are positioned at an angle relative to a central axis of the ring.

4. The jewelry arrangement of claim 1, wherein the at least one through hole in one or more rings within the plurality of rings is formed in a lower portion of the shank opposite an upper portion of the ring having one or more decorative elements thereon.

5. The jewelry arrangement of claim 1, wherein an upper portion of one or more rings within the plurality of rings comprises one or more decorative elements.

6. The jewelry arrangement of claim 1, wherein the rod portion of the alignment tool is adapted for insertion through the first selection of through holes formed in a lower portion of the shank of each ring opposite an upper portion having one or more decorative elements thereon.

7. The jewelry arrangement of claim 1, wherein disengagement of the locking mechanism permits at least one of removal and rearrangement of one or more jewelry pieces from within the jewelry arrangement system.

8. The jewelry arrangement of claim 7, wherein the alignment tool is spring loaded with a safety catch as part of the locking mechanism.

9. The jewelry arrangement of claim 1, wherein a diameter of the rod portion is varied along a length of the rod portion.

10. A jewelry arrangement system having interchangeable components, comprising:

a plurality of jewelry pieces, each jewelry piece having at least one through hole formed in a lower portion thereof opposite an upper portion having one or more decorative elements thereon, wherein each jewelry piece is adapted to be arranged in a particular orientation relative to the other jewelry pieces within the plurality of jewelry pieces; and an alignment tool comprising a head portion and a rod portion, and a locking mechanism on the head portion that is configured to be engaged and disengaged to permit locking and unlocking of the alignment tool, wherein disengagement of the locking mechanism on the head portion permits use of the alignment tool to align different combinations of the at least one through holes formed in the plurality of jewelry pieces, to create a plurality of jewelry arrangements.

11. The jewelry arrangement system of claim 10, wherein at least one jewelry piece of the plurality of jewelry pieces has an upper portion that is asymmetric about its central axis.

12. The jewelry arrangement system of claim 10, wherein at least one jewelry piece of the plurality of jewelry pieces comprises at least two through holes, and selection of a particular one of the through holes determines a degree of rotation of the jewelry piece.

13. The jewelry arrangement system of claim 12, wherein the degree of rotation of the jewelry piece causes a different portion of the jewelry piece to be visible from a top view.

14. The jewelry arrangement system of claim 10, wherein at least one jewelry arrangement of the plurality of jewelry arrangements comprises a subset of the plurality of jewelry pieces.

15. The jewelry arrangement system of claim 10, wherein at least one jewelry arrangement of the plurality of jewelry arrangements comprises a different ordering of the plurality of jewelry pieces than in another jewelry arrangement of the plurality of jewelry arrangements.

16. The jewelry arrangement system of claim 10, wherein at least one jewelry arrangement of the plurality of jewelry arrangements comprises at least one jewelry piece having a different visual appearance in a top view from another jewelry arrangement of the plurality of jewelry arrangements.

17. The jewelry arrangement system of claim 10, wherein the alignment tool is adapted to be hidden from view while the jewelry piece is being worn by a user.

* * * * *